US007748649B2

(12) United States Patent
Fujii et al.

(10) Patent No.: US 7,748,649 B2
(45) Date of Patent: Jul. 6, 2010

(54) WATER DISCHARGING APPARATUS

(75) Inventors: Makoto Fujii, Fukuoka (JP); Shoji Miura, Fukuoka (JP); Yoshihiro Kiyofuji, Fukuoka (JP)

(73) Assignee: Toto Ltd., Fukuoka (JP)

( * ) Notice: Subject to any disclaimer, the term of this patent is extended or adjusted under 35 U.S.C. 154(b) by 1041 days.

(21) Appl. No.: 10/503,767

(22) PCT Filed: Feb. 6, 2003

(86) PCT No.: PCT/JP03/01258

§ 371 (c)(1),
(2), (4) Date: Jan. 11, 2005

(87) PCT Pub. No.: WO03/066976

PCT Pub. Date: Aug. 14, 2003

(65) Prior Publication Data

US 2005/0103895 A1 May 19, 2005

(30) Foreign Application Priority Data

Feb. 6, 2002 (JP) ..... 2002-030163
Feb. 7, 2002 (JP) ..... 2002-031383
Aug. 13, 2002 (JP) ..... 2002-235990

(51) Int. Cl.
*B05B 1/14* (2006.01)

(52) U.S. Cl. ..... 239/548; 239/436; 239/446; 239/554; 239/565; 239/566; 4/568; 4/601

(58) Field of Classification Search ..... 4/567, 4/568, 570, 601; 239/436, 442–446, 448, 239/548, 54, 565, 566
See application file for complete search history.

(56) References Cited

U.S. PATENT DOCUMENTS 335,785 A * 2/1886 Taylor ..... 4/601
1,551,226 A * 8/1925 Vallier ..... 4/567

(Continued)

FOREIGN PATENT DOCUMENTS

JP 8013559 1/1996

(Continued)

*Primary Examiner*—Len Tran
*Assistant Examiner*—Jason J Boeckmann
(74) *Attorney, Agent, or Firm*—Carrier, blackman & Associates, P.C.; Joseph P. Carrier; William D. Blackman

(57) ABSTRACT

It is an object to provide a novel water discharging apparatus capable of rapidly enhancing an outer appearance and a cleaning property and enjoying a plurality of water discharging configurations.

In order to achieve the object, the water discharging apparatus comprises a hot and cold water mixing portion including a housing to which a cold water supply tube and a hot water supply tube are connected respectively, and a hot and cold water generating portion provided in the housing and serving to mix cold water and hot water which are supplied from the cold water supply tube and the hot water supply tube, thereby generating hot and cold water, and a water discharging portion coupled to the hot and cold water mixing portion and serving to discharge the generated hot and cold water from at least one water discharging nozzle, wherein the housing of the hot and cold water mixing portion is formed longitudinally in a vertical direction and the water discharging portion is coupled to an upper part and/or a lower part of the housing.

15 Claims, 15 Drawing Sheets

U.S. PATENT DOCUMENTS 2,336,402 A * 12/1943 Kaiser ..... 4/601
5,121,511 A * 6/1992 Sakamoto et al. ..... 4/601
5,321,860 A * 6/1994 Steinhardt et al. ..... 4/601
5,414,879 A * 5/1995 Hiraishi et al. ..... 4/601
5,428,850 A * 7/1995 Hiraishi et al. ..... 4/601
5,678,258 A * 10/1997 Healy ..... 4/601
D428,643 S * 7/2000 Haug et al. ..... D23/304
6,233,757 B1 * 5/2001 Graham et al. ..... 4/601
6,256,808 B1 * 7/2001 Graham et al. ..... 4/615
6,318,638 B1 * 11/2001 Banno et al. ..... 236/12.2
2003/0019957 A1 * 1/2003 Titinet ..... 239/548

FOREIGN PATENT DOCUMENTS

JP 2-112758 U 9/1999

* cited by examiner

WATER DISCHARGING APPARATUS

CROSS-REFERENCE TO RELATED APPLICATIONS

The present application is a U.S. National phase of, and claims priority based on PCT/JP2003/01258 filed 6 Feb. 2003, which, in turn, claims priority from Japanese patent applications 2002-30163 filed 6 Feb. 2002, 2002-31383 filed 7 Feb. 2002, and 2002-235990 filed 13 Aug. 2002. The entire disclosure of each of the referenced priority documents is incorporated herein by reference.

BACKGROUND OF THE INVENTION

1. Technical Field

The present invention relates to a water discharging apparatus to be installed in a bathroom or a shower room.

2. Background Art

In recent years, bathing and showering have been considered as effective means for refreshing or alleviating stress in addition to a simple habit of washing a body. In order to meet such a demand, a multifunctional type water discharging apparatus comprising various water discharging means having different water discharging directions and configurations, for example, a body shower, a head shower or beating hot water and capable of selecting water discharging means corresponding to a personal taste.

For example, FIG. 17 shows an example in which a water discharging apparatus 200 disclosed in JP-UM-A-2-112758 is installed on a wall W of a bathroom. In this drawing, the reference numeral 201 denotes a hot and cold water mixing discharge device connecting a faucet 202 to a center. A pole 205 is connected to the back face side of the hot and cold water mixing discharge device 201 in an erecting state. A hand shower 203 and a head shower 204 are coupled to the pole 205. Hot and cold water generated in the hot water mixing discharge device 201 can be selectively discharged by properly switching nozzles 207 and 208 of the hand shower 203 and the head shower 204 through a passage switching handle 206 respectively.

On the other hand, such a multifunctional type water discharging apparatus requires a plurality of water discharging means, their fixing members and switching handles. Consequently, components are necessarily increased. Moreover, such a water discharging apparatus becomes one of the main equipments used in a bathroom or a shower room, of which presence cannot be ignored. For this reason, in the selection of the water discharging apparatus, importance is addressed to an outer appearance in addition to a functional aspect thereof. In particular, recently, sparing one's time in a bathroom tends to be increased with spreading of half body bathing or an aromatic therapy (aromatic treatment) in a bathroom. Accordingly, the water discharging apparatus is likely to be seen for a longer time. In the conventional multifunctional type water discharging apparatus, however, a large number of components are simply assembled together in many cases so that there addressed such a problem of an impression of being disorder, or lacking of a total sense of the integration as the whole apparatus.

In the conventional water discharging apparatus, moreover, the hot and cold water mixing discharge device is extended horizontally in a longitudinal (axial) direction. This makes the waterdrops, stacking onto the upper or side surface of the hot and cold water mixing discharge device, difficult to flow. Therefore, there is a problem in that as the waterdrops are kept and dried, the surface of the hot and cold water mixing discharge device might be contaminated with fur. Furthermore, the hot and cold water mixing discharge device is disposed horizontal, while a water discharging portion such as a shower hose is often connected in a vertical or longitudinal (depth) direction. Therefore, when someone attempts to clean up the surface of the device for getting rid of the contamination, there is also a problem in that a wiping direction of the cleaning is not constant, which ends up a cleaning efficiency becoming low.

Further, in some cases of the hot and cold water mixing discharge device being installed in a shower room, the device may be provided on a panel P which is disposed on a corner as shown in FIG. 18. The corner inner portion surrounded by the panel P can be utilized for the space for disposing the piping of a cold water supply and a hot water supply whereby it is not necessary to provide a piping space on the back of a wall with a wall bulged onto an indoor side. Consequently, a certain sufficient room space can be kept. In such a case, however, if the hot and cold water mixing discharge device is disposed in horizontal direction, a wide width is inevitably secured as a width L1 of the installation panel P. Accordingly, a depth L2 of the installation space becomes also increased. Alternatively, in the case of the hot and cold water mixing discharge device being installed on the back face (corner portion) of the panel P, it eventually becomes necessary to take a large corner of the space if the hot and cold water mixing discharge device has a horizontal dimension. As a result, it was quite difficult to achieve an object of securing a sufficient indoor space.

The invention has been made to solve the problems and has an object to provide a novel water discharging apparatus capable of relishing a plurality of water discharging configurations with improving an outer appearance as well as a cleaning condition.

DISCLOSURE OF THE INVENTION

The invention has a first main aspect to provide a water discharging apparatus comprising a hot and cold water mixing portion including a housing to which a cold water supply tube and a hot water supply tube are connected respectively, and a hot and cold water generating portion provided in the housing and serving to mix cold water and hot water which are supplied from the cold water supply tube and the hot water supply tube, and a hot and cold water supply passage provided in the housing and serving to supply said generated hot and cold water to an external part, thereby generating hot and cold water; and a water discharging unit which comprises at least more than one water discharging nozzle, and a fluid passage which is integrally assembled with said at least one water discharging nozzle so as to supply the hot and cold water that is generated in the hot and cold water generating portion, wherein the water discharging unit housing of the hot and cold water mixing portion is formed coupled to an upper part and/or a lower part of the housing, further wherein said hot and cold water supply passage provided in the housing, and said fluid passage provided with the water discharging unit is constituted to be communicated with each other.

According to such a structure, a waterdrop that strikes the hot and cold water mixing portion can easily flow off. Consequently, it is possible to reduce the surface area of the hot and cold water mixing portion which may become contaminated with mold or the like. Moreover, the waterdrop and dirt remaining on the surface of the hot and cold water mixing portion can also be removed by vertical wiping. Consequently, a cleaning property and efficiency can be enhanced. Furthermore, the hot and cold water mixing portion is arranged vertically so that space saving can be achieved and the degree of freedom of an installation layout in a bathroom can be enhanced.

More specifically, in the case in which the hot and cold water mixing portion constituted vertically is to be installed in the corner of a shower room as shown in FIG. 16, it is not necessary to increase a width L11 of an attachment panel as in the conventional example (L1 in FIG. 18). For this reason, it is possible to provide the attachment panel closer to the corner and to reduce a depth L12 of the installation space as compared with the conventional example (L2 in FIG. 18). Accordingly, a sufficient space can be maintained.

Moreover, the individual functional portions are formed into units. Therefore, an influence on a manufacturing cost and a constructing cost can also be minimized.

According to a preferable aspect of the invention, the water discharging unit is constituted by a plurality of water discharging units, the water discharging apparatus further comprising water discharge switching means for selectively switching a water supply to the water discharging units, the water discharge switching means including a housing in which a plurality of passages for supplying the generated hot and cold water to said plurality of water discharging units are formed by a partition, at least two water discharging valves accommodated in the housing and serving to control a water supply/water stop of the hot and cold water to the water discharging units, and operating means for operating the water discharging valve, and the housing being constituted longitudinally in a vertical direction.

According to such a structure, it is possible to provide a plurality of water discharging means having different water discharging directions and configurations while achieving space saving and an enhancement in an outer appearance.

According to another preferable aspect of the invention, the water discharge switching means is constituted as a water discharge switching unit having a housing, a water discharging valve and operating means assembled integrally.

Consequently, it is possible to provide a water discharging apparatus having an excellent cleaning property and an outer appearance with a sense of integration.

According to yet another preferable aspect of the invention, the water discharging valve and/or the water discharging nozzle can be attached and removed forwardly from the housing.

Also after the water discharging apparatus is assembled, consequently, it is possible to easily attach and remove the water discharging valve and/or the water discharging nozzle. Thus, an excellent maintenance property can be obtained.

According to a further preferable aspect of the invention, the water discharging nozzle is at least one selected from a faucet nozzle for intensively discharging the hot and cold water downward from a faucet nozzle, a hand shower nozzle, being connected to a tip of a flexible shower hose, capable of dispersedly or intensively discharging the hot and cold water to a user's body from a hand shower nozzle connected to a tip of a flexible shower hose, a body shower nozzle capable of dispersedly or intensively discharging the hot and cold water toward the user's body from a body shower nozzle, and a head shower nozzle, being provided at upper part of the user's body, capable of dispersedly or intensively discharging the hot and cold water toward the user's body.

According to such a structure, a user or a person for carrying out an installation can freely select the layout and function of the water discharging apparatus. Consequently, a commercial value can be increased.

According to a further preferable aspect of the invention, a plurality of the water discharging units can be mutually coupled in a vertical direction.

According to such a structure, also in the case in which a plurality of water discharging units is combined, it is possible to obtain an excellent outer appearance having a sense of integration. Moreover, a waterdrop can easily flow downward. Consequently, dirt adheres to the surface with difficulty.

According to a further preferable aspect of the invention, the water discharging portion is a head shower capable of dispersedly or intensively discharging hot and cold water from a head shower nozzle provided above a user toward the user's body, and the head shower nozzle includes a plurality of water discharging portions protruded like a curve from a flat water discharging plate and the hot and cold water is discharged from a plurality of water discharging holes provided dispersedly in the vicinity of tops of the water discharging portions.

Consequently, it is possible to intensively discharge the water of the shower from the shower nozzle into the vicinity of the user's body. Moreover, the number of the water discharging holes can be minimized. Consequently, it is possible to provide the discharge of water of the shower having a sufficient massive sense also in a place having a low water pressure.

According to a further preferable aspect of the invention, the hot and cold water mixing portion includes a temperature regulating handle for regulating a temperature of hot and cold water to be generated, and a temperature control portion for controlling the temperature of the hot and cold water in accordance with an operation of the temperature regulating handle, the temperature control portion has a control valve member for sliding in the hot and cold water mixing portion in a vertical direction to change a mixing ratio of cold water or hot water which is supplied from the cold water supply portion and the hot water supply portion, a temperature sensitive spring for pressing and energizing the control valve member toward one side in the vertical direction by using a shape-memory alloy, and a bias spring for pressing and energizing the control valve member toward the other side in the vertical direction, and the temperature control portion serves to control a position in the vertical direction of the control valve member by a balance of the two springs.

Consequently, it is possible to instantaneously control the temperature of the hot and cold water also in the case in which the hot and cold water mixing portion is provided in the vertical direction.

According to a second main aspect of the invention, it provides a water discharging apparatus comprising a hot and cold water mixing portion including a housing, being formed longitudinally in vertical direction, to which a cold water supply tube and a hot water supply tube are connected respectively, a hot and cold water generating portion provided in the housing and serving to mix cold water and hot water which are supplied from the cold water supply tube and the hot water supply tube, and, thereby generating hot and cold water; a plurality of water discharging units which are coupled to upper parts and/or lower parts of the housing; and a water discharge switching unit which selectively switches a water supply to said plurality of water discharging units, wherein each of said plurality of water discharging units comprises at least more than one water discharging nozzle for discharging the hot and cold water that is generated by the hot and cold water mixing portion, and a water discharging unit body having a fluid passage for supplying the hot and cold water to the water discharging nozzle, both being integrally assembled, further wherein said water discharge switching unit comprises a housing which is formed longitudinally in a vertical direction where a plurality of fluid passages are formed in a segmentation arrangement to supply the hot and cold water to said plurality of water discharging units, at least more than one water discharging valve which is provided in the housing so as to control supply or stoppage of the hot and cold water to said plurality of water discharging units, and operating means for operating the water discharging valve, all of which being integrally assembled, and further wherein said water switching unit and at least any one of said plurality of water discharging units are constituted to be mutually coupled in a vertical direction.

According to such a structure, a waterdrop that strikes the hot and cold water mixing portion can easily flow off. Consequently, it is possible to reduce the surface of the hot and cold water mixing portion which is contaminated with mold or the like. Moreover, the waterdrop and dirt remaining on the surface of the hot and cold water mixing portion can also be removed by vertical wiping. Consequently, a cleaning property and efficiency can be enhanced. Furthermore, the hot and cold water mixing portion is constituted vertically so that space saving can be achieved and the degree of freedom of an installation layout in a bathroom can be enhanced. It is also possible to obtain an excellent outer appearance with a sense of integration.

According to a further preferable aspect of the invention, the hot and cold water mixing portion is constituted as a hot and cold water mixing unit having the housing and the hot and cold water mixing portion assembled integrally, and the water discharging unit, the hot and cold water mixing unit and the water discharge switching unit can be mutually coupled in a vertical direction.

According to such a structure, also in the case in which a user or a person for carrying out an installation freely selects the layout and function of the water discharging apparatus, it is possible to easily perform an assembly by coupling the functional units in combination.

According to a further preferable aspect of the invention, the water discharging unit body of the water discharging unit is formed to have an equal diameter to a diameter of the housing of the hot and cold water mixing portion.

Consequently, it is possible to provide a novel water discharging apparatus in which the hot and cold water mixing portion and the water discharging unit have an outer appearance with a sense of integration.

According to a further preferable aspect of the invention, it provide a water discharging apparatus comprising a hot and cold water mixing portion and a water discharging unit coupled to said hot and cold water mixing portion, wherein the hot and cold water mixing portion includes a housing to which a cold water supply tube and a hot water supply tube are connected respectively, a hot and cold water generating portion provided in the housing and serving to mix cold water and hot water which are supplied from the cold water supply tube and the hot water supply tube, and a temperature regulating handle connected coaxially to an upper end or a lower end of the housing and serving to regulate a temperature of hot and cold water to be generated, and a flow regulating handle connected coaxially to the upper end or the lower end of the housing and serving to regulate a flow of the hot and cold water to be discharged from the water discharging unit, further wherein said water discharging unit is coupled to an upper end and/or a lower end of the housing of the hot and cold water mixing portion and serving to discharge water from at least more than one water discharging nozzle, further wherein the two handles are formed with equal diameters to a diameter of the housing.

According to such a structure, a waterdrop that strikes the hot and cold water mixing portion can easily flow off. Consequently, it is possible to reduce the surface of the hot and cold water mixing portion which is contaminated with fur. Moreover, the waterdrop and dirt remaining on the surface of the hot and cold water mixing portion can also be removed by vertical wiping. Consequently, a cleaning property can be enhanced. Furthermore, the hot and cold water mixing portion is constituted vertically so that space saving can achieved and the degree of freedom of an installation layout in a bathroom can be enhanced. It is also possible to obtain an excellent outer appearance having a sense of integration for the hot and cold water mixing portion and the water discharging unit, which presents an epoch making water discharging apparatus.

BRIEF DESCRIPTION OF THE DRAWINGS

FIG. 17 is a general perspective view showing an example of a conventional multifunctional type water discharging apparatus, and FIG. 18 is a view showing an example in which the conventional water discharging apparatus is installed on the corner of a bathroom.

DETAILED DESCRIPTION INCLUDING BEST MODE FOR CARRYING OUT THE INVENTION

The invention will be more specifically described below with reference to the drawings.

(Total Structure of Water Discharging Apparatus)

Figure 1:
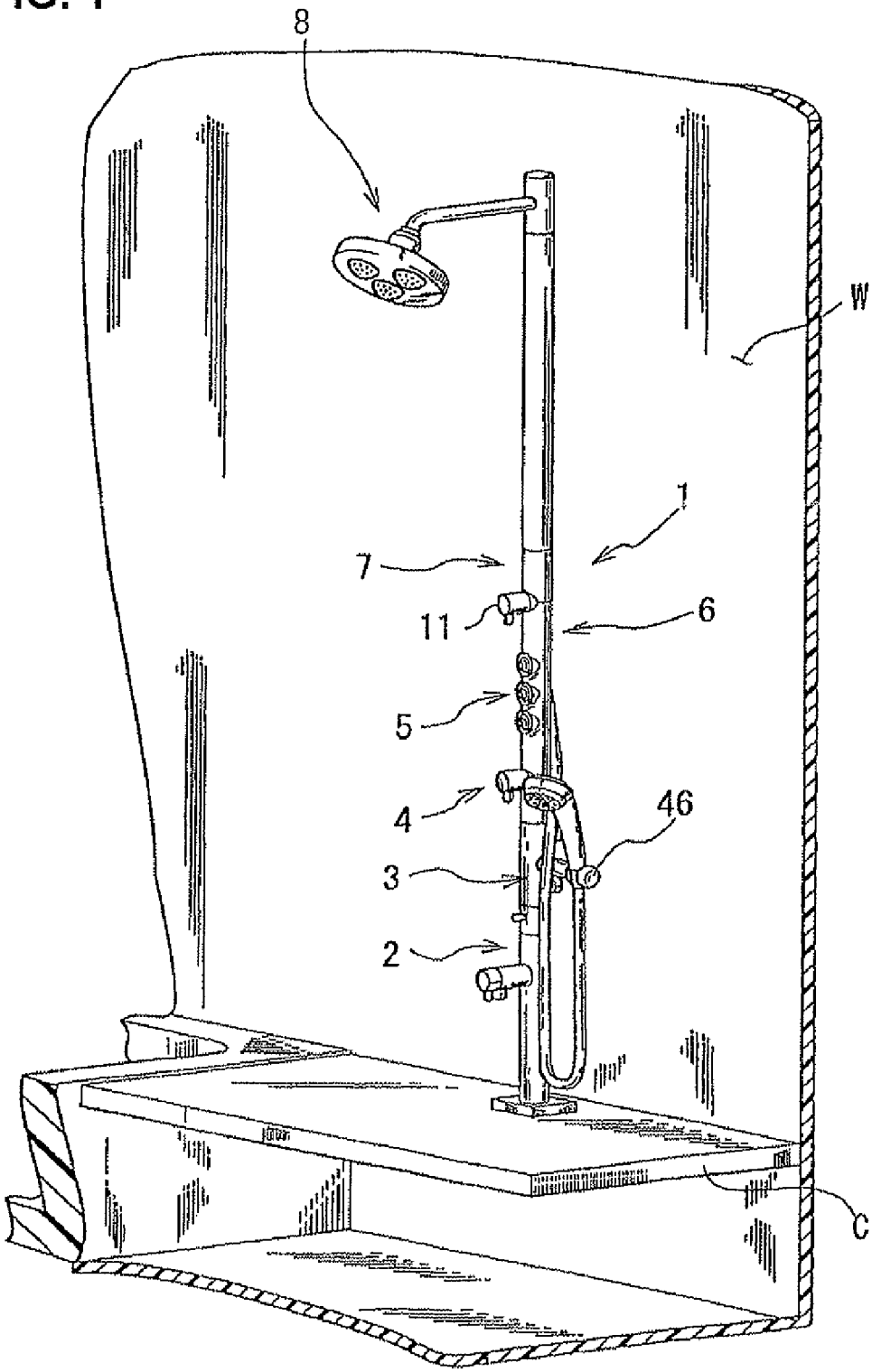
FIG. 1 is a perspective view showing an example in which a water discharging apparatus according to an embodiment of the invention is installed on a wall surface over the counter of a bathroom.
Figure 2:
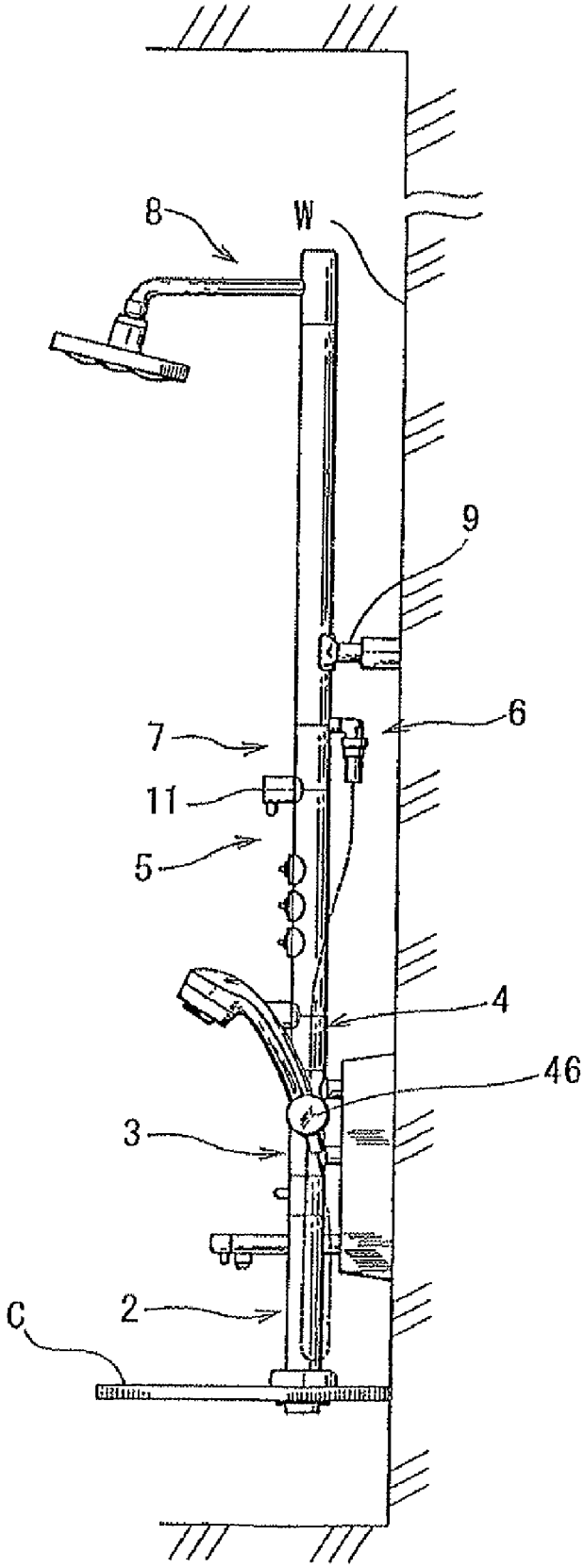
FIG. 2 is a side view showing the water discharging apparatus in FIG. 1.

FIGS. 1 and 2 show a total structure in the case in which a water discharging apparatus according to an embodiment of the invention is installed on a wall surface W over a counter C of a bathroom.

A water discharging apparatus 1 is totally constituted like a pole with a plurality of functional units coupled to each other in a vertical direction. In the embodiment, the functional units include a faucet unit 2, a hot and cold water mixing unit 3, a body shower water discharging operation unit 4, a body shower unit 5, a hand shower unit 6, a water discharge switching unit 7 and a shower unit 8 in ascending order. The specification of the coupled portions of these functional units (2 to 8) is common and mutual coupling and exchange can be carried out. Consequently, a user can select a favorite water discharging function to carry out a layout. The reference numeral 9 in FIG. 2 is a wall fixture for fixing the water discharging apparatus 1 to a wall surface W of a bathroom.

As will be described below in detail, the functional units (2 to 8) are connected in such a manner that water paths provided in an inner part mutually communicate with each other. Consequently, hot and cold water generated in the hot and cold water mixing unit 3 can be selectively discharged from the respective water discharging units (2, 5, 6, 8).

Moreover, the functional units (2 to 8) are formed with outside diameters which are equal to each other. Consequently, it is possible to obtain an excellent outer appearance having a sense of integration. Furthermore, concavo-convex portions are lessened. Therefore, a waterdrop easily flows so that dirt can be prevented from being stuck thereon, and furthermore, a cleaning property can also be enhanced rapidly.

The water discharging apparatus 1 provides four types of water discharging configurations including a faucet water discharge, a body shower, a hand shower and a head shower to the user. The user can selectively switch the water discharging configurations by operating a flow regulating handle of each water discharging unit or a switching handle 11 of the water discharge switching unit 7 which will be described below.

Referring to FIGS. 3 to 9, next, description will be given to the structure of each of the functional units.

(Faucet Unit)

Figure 3:
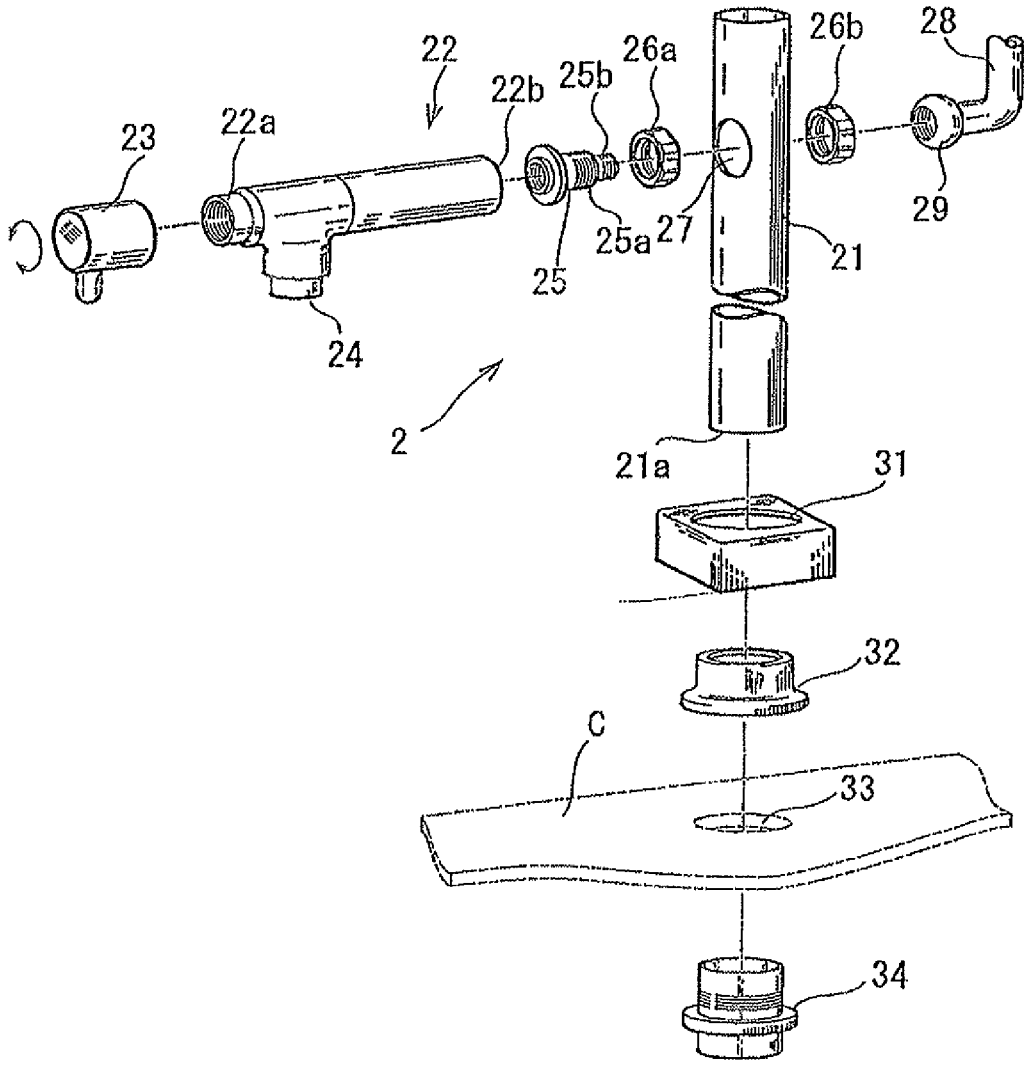
FIG. 3 is an exploded perspective view showing a faucet unit.

The faucet unit 2 is constituted by a pipe 21 extended in a vertical direction and a faucet body 22 in a horizontal direction which is attached to the pipe 21 as shown in FIG. 3.

The faucet body 22 includes a flow regulating valve (not shown) such as a cylinder valve. A flow regulating handle 23 is connected to a tip portion 22*a* of the faucet body 22. The flow regulating handle 23 is connected to the flow regulating valve to operate the switching and the degree of opening (flow amount) of the flow regulating valve. A spout nozzle 24 for intensively discharging the hot and cold water mixed in the hot and cold water mixing unit 3 downward is connected to a lower surface at the tip side of the faucet body 22. The user can control the degree of opening of the flow regulating valve to regulate the amount of water discharged from the spout nozzle 24 by rotating the flow regulating handle 23 in a circumferential direction.

Next, description will be given to the attachment structure of the pipe 21 and the faucet body 22. An attachment bolt 25 provided with outer grooves having different diameters in two stages is fixed to a rear end 22*b* of the faucet body 22. An inside nut 26*a* is screwed into a screw groove 25*a* having a large diameter in the attachment bolt 25 and the tip of the attachment bolt 25 is then inserted into a pair of openings 27 (only one of them at an indoor side is shown) provided on the side surface of the pipe 21. An outside nut 26*b* is screwed into the screw groove 25*a* having a large diameter in the attachment bolt 25 which is protruded from an opening on the wall side of the pipe 21, thereby fixing the pipe 21 to the faucet body 22. Moreover, a cap nut 29 is attached to the outside of a connecting tube 28 connected to the hot and cold water mixing unit 3, and is screwed and fixed into a screw groove 25*b* having a small diameter in the attachment bolt 25. A watertight seal is provided in each connecting portion if necessary. Consequently, the pipe 21 and the faucet body 22 are fixed integrally so that the faucet unit 2 is completed.

Subsequently, the attachment structure of the pipe 21 and a counter C will be briefly described. First of all, a cover member 31 and a nut 32 having a flange are externally inserted into the lower end of the pipe 21 respectively so as to be inserted through an opening 33 provided on the counter C of a bathroom. In this state, the tip of a bolt 34 having a flange is externally fitted in an opening 21*a* on the lower end of the pipe 21. Next, the nut 32 is screwed into the bolt 34 and the counter C is interposed between the nut 32 and the flange of the bolt 34 from both upper and lower surfaces thereof. Consequently, the pipe 21 can be supported on the counter C. Finally, the upper part of the nut 32 is hidden by the cover member 31. The pipe 21 may be mounted and fixed onto the floor surface of the washing place of a bathroom or a shower room. In this case, a water supply tube and/or a hot water supply tube which are/is raised from the floor surface can be connected to the hot and cold water mixing unit 3 in the pipe 21.

(Hot and Cold Water Mixing Unit)

Figure 4:
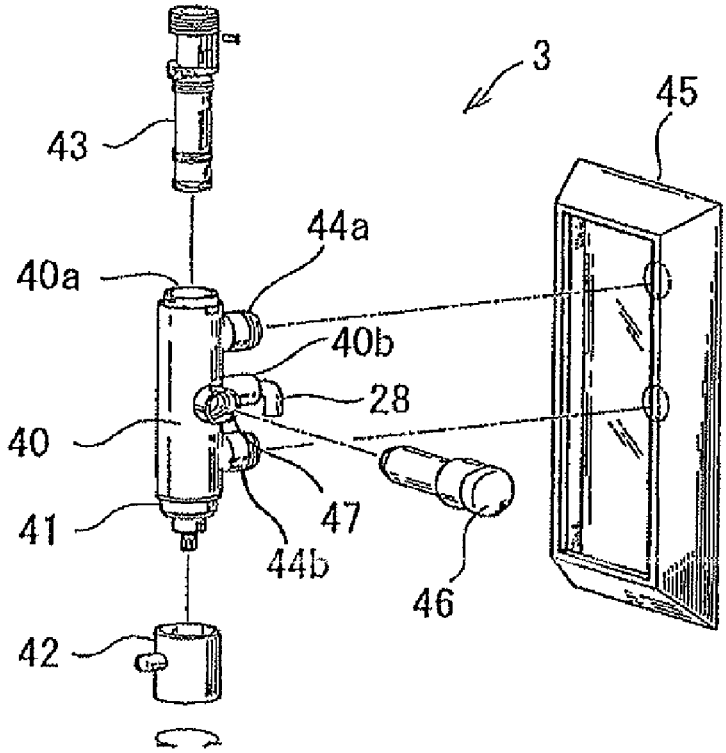
FIG. 4 is an exploded perspective view showing a hot and cold water mixing unit.

As shown in FIG. 4, the hot and cold water mixing unit 3 is constituted by a metallic housing 40 formed like a long cylinder which is extended in a vertical direction, a hot and cold water mixing portion 41 accommodated in the housing 40, a water discharging temperature regulating handle 42 coupled to the lower part of the hot and cold water mixing portion 41 and serving to regulate the temperature of the hot and cold water discharged from each water discharging unit, and a coupling 43 connected to a valve body 56 of the body shower water discharging operation unit 4 which will be described below.

An upper end opening 40*a* of the housing 40 and a branch port 40*b* provided on a back face (the wall surface W side of the bathroom) communicate with the water discharging means (the water discharging units), respectively. The opening 40*a* and the branch port 40*b* serve as supply paths for supplying the hot and cold water generated in the hot and cold water mixing portion 41 to these water discharging units. More specifically, first of all, the upper end opening 40*a* of the housing 40 serves as a supply path to the body shower unit 5, the hand shower unit 6 and the head shower unit 8 through the body shower water discharging operation unit 4. Moreover, the branch port 40*b* serves as a supply path to the faucet unit 2. The upper end of the connecting tube 28 (see FIG. 3) of the faucet unit 2 is connected to the branch port 40*b*.

Moreover, the housing 40 is connected to the cold water supply tube and the hot water supply tube (which are not shown) provided on the back side of the wall W of the bathroom through a pair of leg portions 44*a* and 44*b*, respectively. The leg portions 44*a* and 44*b* include water discharge devices respectively, which are not shown. Moreover, the leg portions 44*a* and 44*b* are hidden by a leg portion cover 45. Consequently, concavo-convex portions provided around the connecting portion can be hidden so that an outer appearance and a safety can be enhanced, and furthermore, an adiabatic effect around the hot water supply tube can also be obtained. In the drawing, the reference numeral 46 denotes a shower hook for engaging the hand shower nozzle of the hand shower unit 6. The shower hook 46 is screwed and fixed to an attachment hole 47 provided in the side portion of the housing 40.

Figure 5:
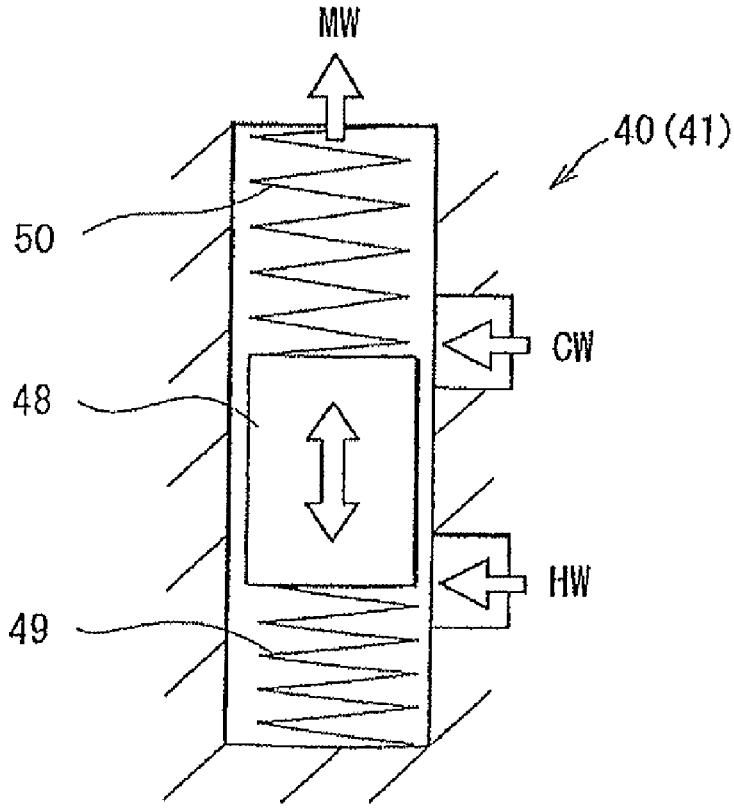
FIG. 5 is a typical view showing the temperature regulating mechanism of a hot and cold water mixing portion.

FIG. 5 typically shows the hot water temperature control mechanism of the hot and cold water mixing portion 41. More specifically, the hot and cold water mixing portion 41 includes a control valve member 48 for controlling the mixing ratio of hot water (HW) to cold water (CW), a bias spring 49 provided under the control valve member 48, and a temperature sensitive spring 50 provided on the downstream side of the control valve member 48 and serving to energize the control valve member 48 in an upward direction. In FIG. 5, a water discharging path to the faucet unit 2 is omitted.

The control valve member 48 serves to slide in a vertical direction in the housing 40 to change the opening area of the connecting portion of the cold water supply tube to the hot water supply tube, thereby controlling the mixing ratio of the hot water to the cold water.

The bias spring 49 is made shorter than a natural length thereof and is previously compressed and deformed, and is thus accommodated in the housing 40. Moreover, the temperature sensitive spring 50 is formed like a coil by a shape-memory alloy such as a Ni—Ti alloy. The temperature sensitive spring 50 has the function of reacting to the temperature of the hot water (MW) generated by the control valve member 48 to cause the control valve member 48 to slide in a vertical direction. The hot water temperature control mechanism according to the embodiment serves to move the control valve member 48 in the vertical direction by the balance of the two springs 49 and 50, thereby changing the opening area of an inlet port for each of cold water and hot water from the connecting portion of the cold water supply tube and the hot water supply tube (the degree of opening of a valve seat). More specifically, the temperature sensitive spring 50 is provided on the downstream side of a hot and cold water mixing chamber 53 (see FIG. 6) which will be described below, and serves to change a spring constant corresponding to the temperature of the hot water (MW) generated in the mixing chamber 53, thereby regulating the position in the vertical direction of the control valve member 48 together with the bias spring 49. Consequently, an automatic temperature regulating function can be exhibited in order to continuously obtain hot water having a preset temperature. More specifically, the temperature sensitive spring 50 is deformed to increase an axial length and moves the control valve member 48 downward when the temperature of the mixed water is higher than a preset value. Consequently, the opening area of the connecting portion to the hot water supply tube is decreased and the opening area of the connecting portion to the water supply tube is increased. Thus, the mixing ratio of the cold water can be increased to drop the temperature of the hot water to be generated to a preset value. In the case in which the temperature of the mixed water is lower than the preset value, the control valve member 48 is moved in an upward direction to increase the opening area of the connecting portion to the hot water supply tube, thereby increasing the mixing ratio of the hot water. For such an automatic temperature regulating function and an attendant mechanism thereon, it is possible to properly employ the conventionally well-known technique. For example, it is preferable that the two springs 49 and 50 should be installed in combination with a spring holding seat or a spring head in order to move in only an axial direction without rotating axially.

Figure 6:
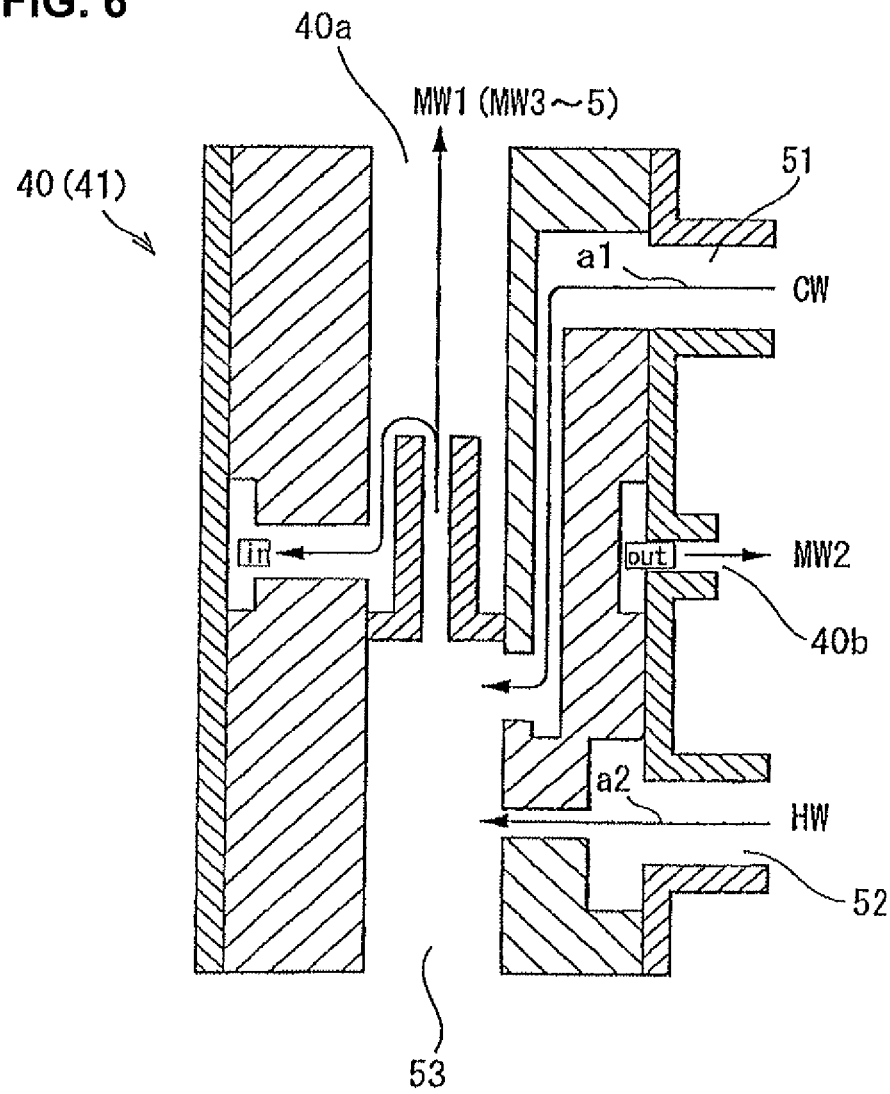
FIG. 6 is a schematic sectional view showing the flow of hot and cold water in the hot and cold water mixing portion.

Next, a passage for the hot water generated in the hot and cold water mixing portion 41 will be described with reference to FIG. 6.

First of all, when a user operates the flow regulating handle of any of the water discharging units to open a switching valve, cold water (CW) and hot water (HW) flowing from the cold water supply tube and the hot water supply tube of the wall surface W of the bathroom (on the right side of the paper) are supplied to the mixing chamber 53 through passages 51 and 52 as shown in arrows a1 and a2. The hot water temperature control mechanism shown in FIG. 5 is provided in the passages 51 and 52 and the mixing chamber 53 and is not shown in FIG. 6 for simplicity of the drawing. The hot water (MW) generated in the mixing chamber 53 is supplied as MW1 (MW3 to 5) and MW2 to a plurality of water discharging units from the upper end opening 40*a* and the branch port 40*b* in the housing 40.

As described above, in the embodiment, the hot water temperature control mechanism is provided in a vertical direction in the long cylindrical housing 40 extended in the vertical direction and the hot and cold water mixing unit 3 is extended in the vertical direction. Consequently, a space for installing the hot water mixing unit 3 can be reduced, and furthermore, a cleaning property can be enhanced. Also in the case in which the hot and cold water mixing unit 3 is combined with a plurality of water discharging units, particularly, a projection in a transverse direction can be mostly eliminated. Accordingly, the water discharging apparatus 1 can be assembled with a design having a sense of unification so that an outer appearance can be remarkably enhanced.

(Body Shower Water Discharging Operation Unit)

Figure 7A:
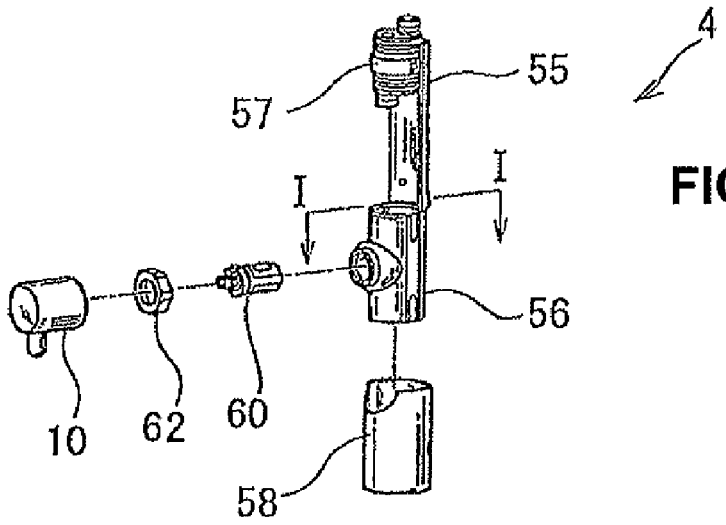
FIG. 7 is a view showing the schematic structure of a body shower water discharging operation unit, (A) being an exploded perspective view, (B) being a sectional view taken along a I-I line of (A), and (C) being a sectional view taken along a II-II line in (B)

As shown in FIG. 7(A), the body shower water discharging operation unit 4 is constituted by a curved plate 55 extended in a vertical direction, a valve body 56 provided ahead of the curved plate 55, a coupling 57 coupled to the upper end of the valve body 56, and a cover member 58 for covering the outer periphery of the lower part of the valve body 56. The valve body 56 includes a passage 59 for hot and cold water which is formed by a partition on an inner part and a housing 61 of a water discharging cylinder 60 and is formed like a long cylinder extended in the vertical direction as shown in a section of FIG. 7(B). The cylindrical water discharging handle 10 for rotating the cylinder 60 is coupled to the front end of the water discharging cylinder 60. The water discharging handle 10 is rotatably fitted in the valve body 56. The lower end of the valve body 56 is connected to the upper end of a coupling 43 of the hot and cold water mixing unit 3 and their connecting portion is covered with the cover member 58. For this reason, the upper end on the front side of the cover member 58 has a circular notch for conforming to the shape of the water discharging handle 10.

Both the water discharging handle 10 and the water discharging cylinder 60 are removably attached from a forward part. More specifically, the water discharging handle 10 is simply fitted in the valve body 56 and can be therefore removed easily by means of a tool such as a driver. Moreover, the water discharging cylinder 60 is fixed with a nut 62 screwed into the valve body 56 and can be therefore removed easily. Also after the water discharging apparatus 1 is assembled, accordingly, the water discharging handle 10 and the water discharging cylinder 60 can easily be repaired and maintained.

Figure 7B:
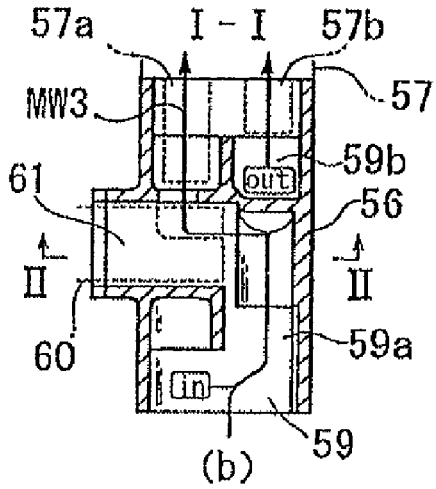
Figure 7C:
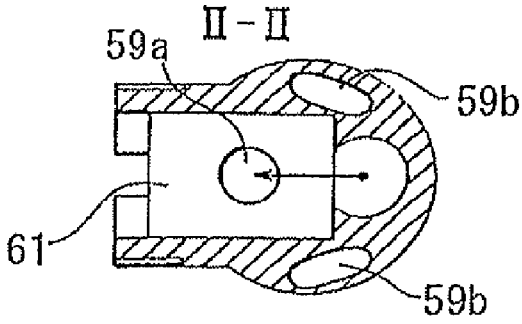

As shown in FIG. 7(B), the passage 59 of the valve body 56 branches into a passage 59*a* for a body shower at a lower end and a passage 59*b* (see FIG. 7(C)) for a hand shower and a head shower. The passage 59*a* for a body shower switches a water discharge (open)/a water stop (close) by means of the water discharging cylinder 60 and the water discharging handle 10. The other passage 59*b* is always opened irrespective of the position of the water discharging cylinder 60. The passages 59*a* and 59*b* are caused to communicate with the passages 57*a* and 57*b* in the coupling 57 with the coupling 57 connected thereto.

With such a structure, the user rotates the water discharging handle 10 so that the water discharging cylinder 60 is rotated interlockingly to cause the passage 59*a* in the valve body 56 to communicate. Thus, the hot water MW2 is supplied through the passage 57*a* in the coupling 57 to the body shower unit 5 connected to an upper part.

(Body Shower Unit)

Figure 8:
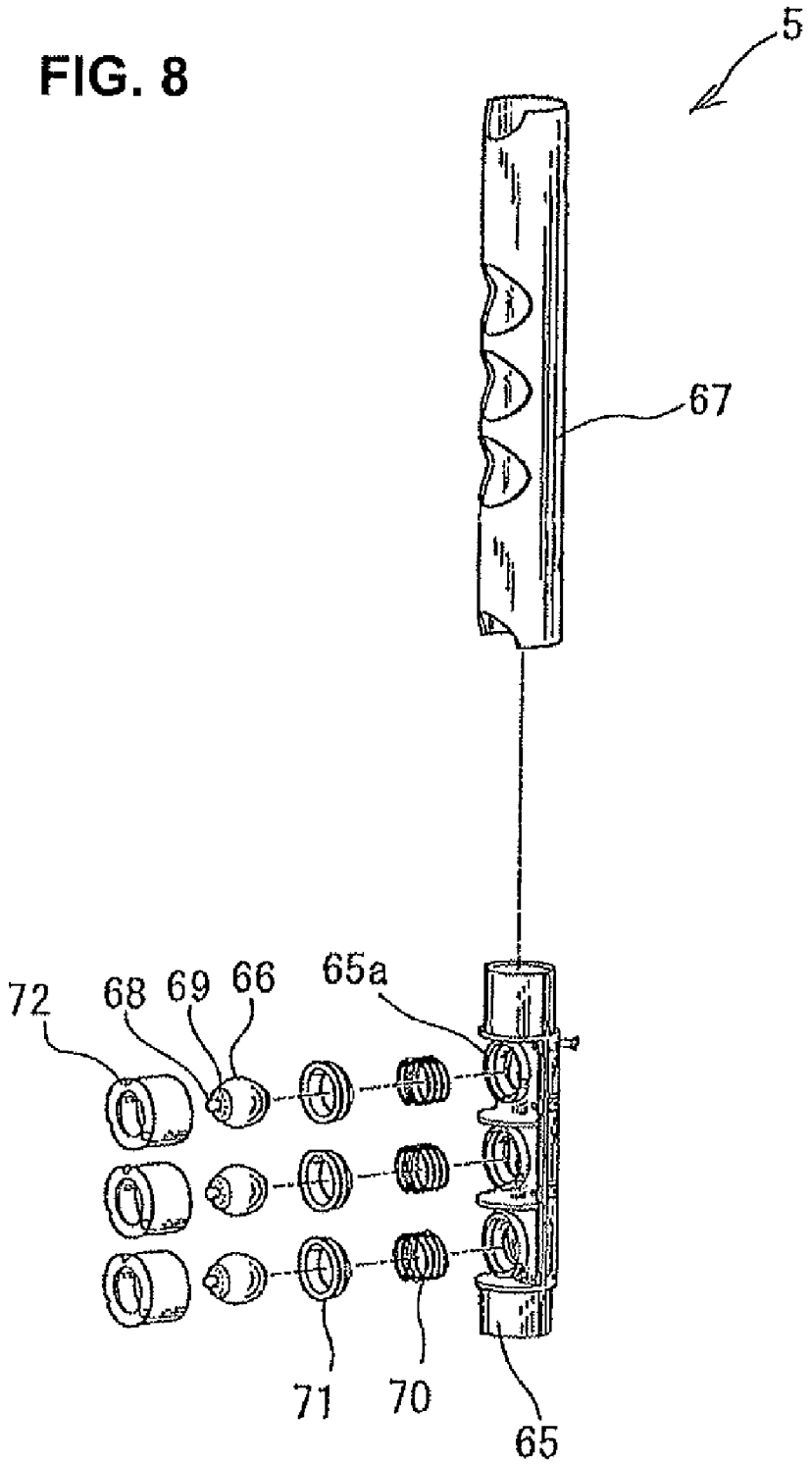
FIG. 8 is an exploded perspective view showing a body shower unit.

As shown in FIG. 8, the body shower unit 5 is constituted by a long cylindrical body shower body 65 extended in a vertical direction, a plurality of (three in an example shown in the drawing) body shower nozzles 66 taking the shape of an elliptical sphere which is arranged in a vertical direction ahead of the body shower body 65, and a cover member 67 for covering the outer peripheral side of the body shower body 65. The front side on the lower end of the cover member 67 has a circular notch to conform to the shape of the cylindrical water discharging handle 10. Moreover, the front side on the upper end of the cover member 67 has a circular notch to conform to the shape of the switching handle 11 of the water discharge switching unit 7.

A knob 68 for changing the direction of the nozzle 66 and a plurality of water discharging holes 69 are provided on the tip of the body shower nozzle 66 respectively. The body shower nozzle 66 is slidably attached to a pedestal 65*a* of the body shower body 65 through a coil spring 70 and a nozzle guide 71.

Moreover, a cylindrical cover 72 having a slightly larger diameter than the diameter of the nozzle 66 is fitted in the front surface of the body shower body 65. By the cylindrical cover 72, the body shower nozzle 66 is held in a predetermined position, and furthermore, a range (an angle) in which a water discharging direction can be changed is controlled into a predetermined range. Since all of the body shower nozzle 66, the coil spring 70, the nozzle guide 71 and the cylindrical cover 72 can be attached and removed from a forward part, a maintenance can easily be carried out.

The lower end of the body shower body 65 is coupled to the upper end of the coupling 57 of the body shower water discharging operation unit 4. Consequently, the hot water flowing from the passage 57*a* for the body shower can be discharged from the body shower nozzle 66 toward a user's body.

The shapes of the body shower nozzles 66 and the number and positions of the water discharging holes 69 may be varied to cause the water discharging configurations of the nozzles 66 to be different from each other. Furthermore, a water discharging valve and a water discharging handle may be provided for each of the body shower nozzles 66 to select the different water discharging configurations.

(Water Discharge Switching Unit)

Figure 9A:
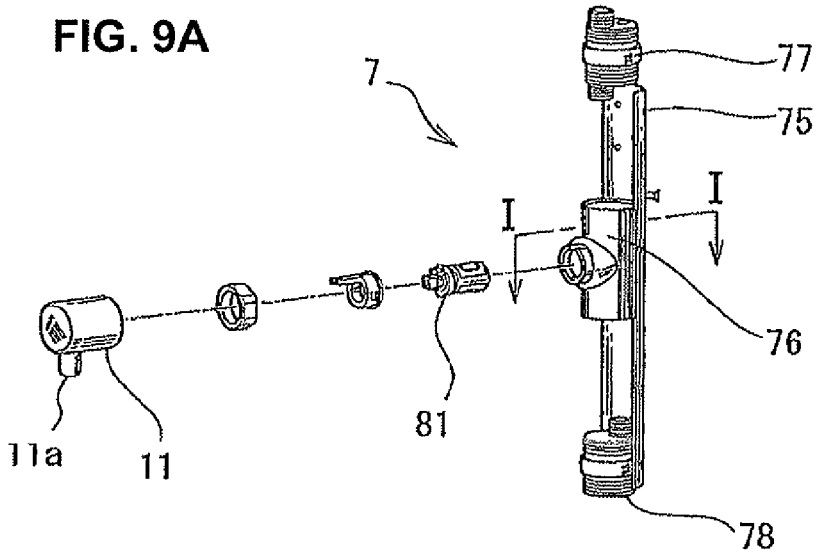
FIG. 9 is a view showing the schematic structure of a water discharge switching unit, (A) being an exploded perspective view, (B) being a sectional view taken along a I-I line in (A), and (C) being a sectional view taken along a II-II line in (B)

The water discharge switching unit 7 has the function of selectively switching a water discharge from the hand shower unit 6 and the head shower unit 8 as shown in FIG. 9. The water discharge switching unit 7 is constituted by a curved plate 75 extended in a vertical direction, a valve body 76 provided ahead of the curved plate 75, and couplings 77 and 78 coupled to the upper and lower ends of the valve body 76, respectively.

Figure 9B:
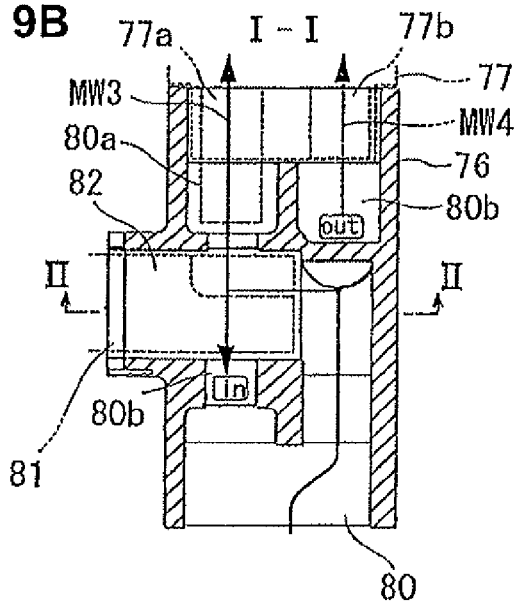

The valve body 76 includes a passage 80 for hot and cold water and a housing 82 of a cylinder valve 81 therein and is formed like a long cylinder extended in the vertical direction as shown in a section of FIG. 9(B). The cylindrical switching handle 11 for rotating the valve 81 is coupled to the front end of the cylinder valve 81. The switching handle 11 is rotatably fitted in the valve body 76. The lower end of the valve body 76 is connected to the upper end of the body shower body 65 through the coupling 78.

Since both the cylinder valve 81 and the switching handle 11 can be attached and removed from a forward part in the same manner as the water discharging handle 10 of the body shower water discharging operation unit 4, a maintenance can easily be carried out.

Figure 9C:
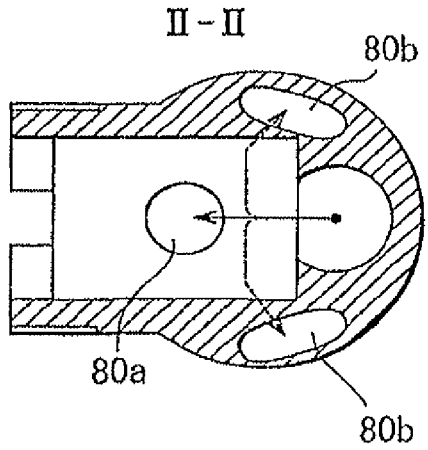

As shown in FIG. 9(B), the passage 80 of the valve body 76 branches into a passage 80*a* for a head shower and a passage 80*b* for a hand shower (see FIG. 9(C)). The switching and the water discharge (open)/water stop (close) of the passages 80*a* and 80*b* are controlled by the cylinder valve 81 and the switching handle 11. More specifically, when the user rotates the switching handle 11 clockwise in a water stopping state in which a knob 11*a* of the switching handle 11 is positioned in a lower part, the cylinder valve 81 is also rotated clockwise to cause the passage 80*a* to communicate interlockingly with the switching handle 11. In this state, the hot water MW3 is supplied to the head shower unit 8 as shown in a solid line of FIG. 9(B). Moreover, a flow is regulated corresponding to a rotating angle. To the contrary, in the case in which the switching handle 11 is rotated counterclockwise, the cylinder valve 81 causes the passage 80*b* to communicate. As shown in a broken line of FIG. 9(B), therefore, the hot water MW4 is supplied to the hand shower unit 6. As shown in FIGS. 9(B) and 9(C), the hot water MW4 supplied to the hand shower unit 6 once comes down from the housing 82 of the cylinder valve 81 and flows upward in the flat passages 80*b* and 80*b* provided in both side portions on the rear side of the valve body 76 to reach a connecting portion to the upper coupling 77.

(Hand Shower Unit)

Figure 10A:
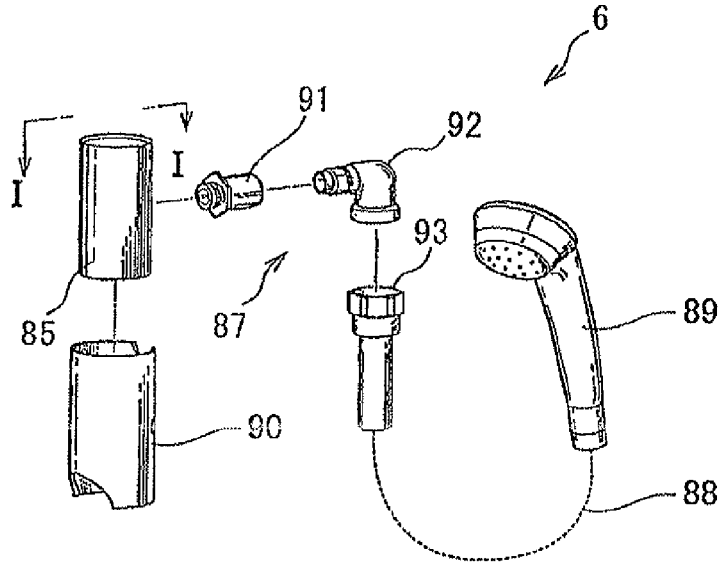
FIG. 10 is a view showing the schematic structure of a hand shower unit, (A) being an exploded perspective view, (B) being a sectional view taken along a I-I line in (A), and (C) being a sectional view taken along a II-II line in (B)
Figure 10B:
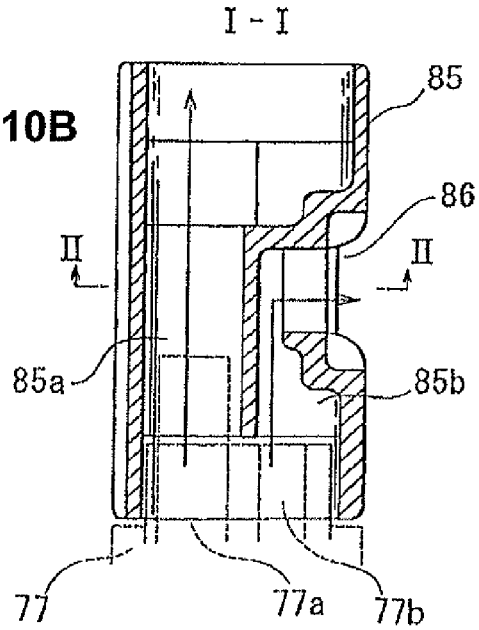

As shown in FIG. 10, the hand shower unit 6 is constituted by a long cylindrical unit body 85 extended in a vertical direction, a branching metal fitting 87 fixed to an opening 86 (see FIG. 10(B)) provided on the back face (wall side) of the unit body 85, a hand shower nozzle 89 connected through a flexible shower hose 88 to the tip of the branching metal fitting 87, and a cover member 90 for covering the outer periphery of the unit body 85. The branching metal fitting 87 is constituted by a bush 91 having one of ends screwed and fixed to the opening 86, a downward L-shaped elbow 92 screwed to the other end of the bush 91, and a shower hose connecting metal fitting 93 which is coupled to the lower end of the elbow 92 and to which one of the ends of the shower hose 88 is connected. The hand shower nozzle 89 is engaged with a shower hook 46 (see FIGS. 1, 2 and 4) attached to the housing 40 of the hot and cold water mixing unit 3 in non-use. In the cover member 90, moreover, a lower end on a front side and an upper end on a rear side have circular notches to conform to the shapes of the switching handle 11 of the water discharge switching unit 7 and the branching metal fitting 87, respectively.

Figure 10C:
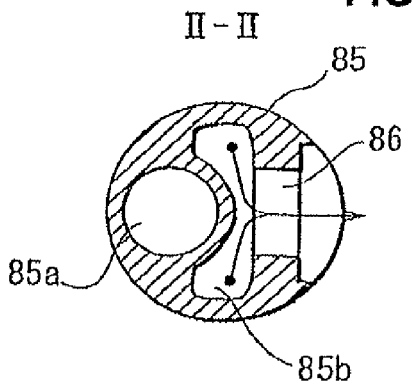

As shown in sections of FIGS. 10(B) and 10(C), a passage 85*a* for a head shower and a passage 85*b* for a hand shower are formed on the unit body 85 by a partition, respectively. The passage 85*a* for a head shower communicates with a passage 77*a* for a head shower of the upper coupling 77 of the water discharge switching unit 7. Moreover, the passage 85*b* for a hand shower communicates with a passage 77*b* for a hand shower of the upper coupling 77.

(Head Shower Unit)

Figure 11:
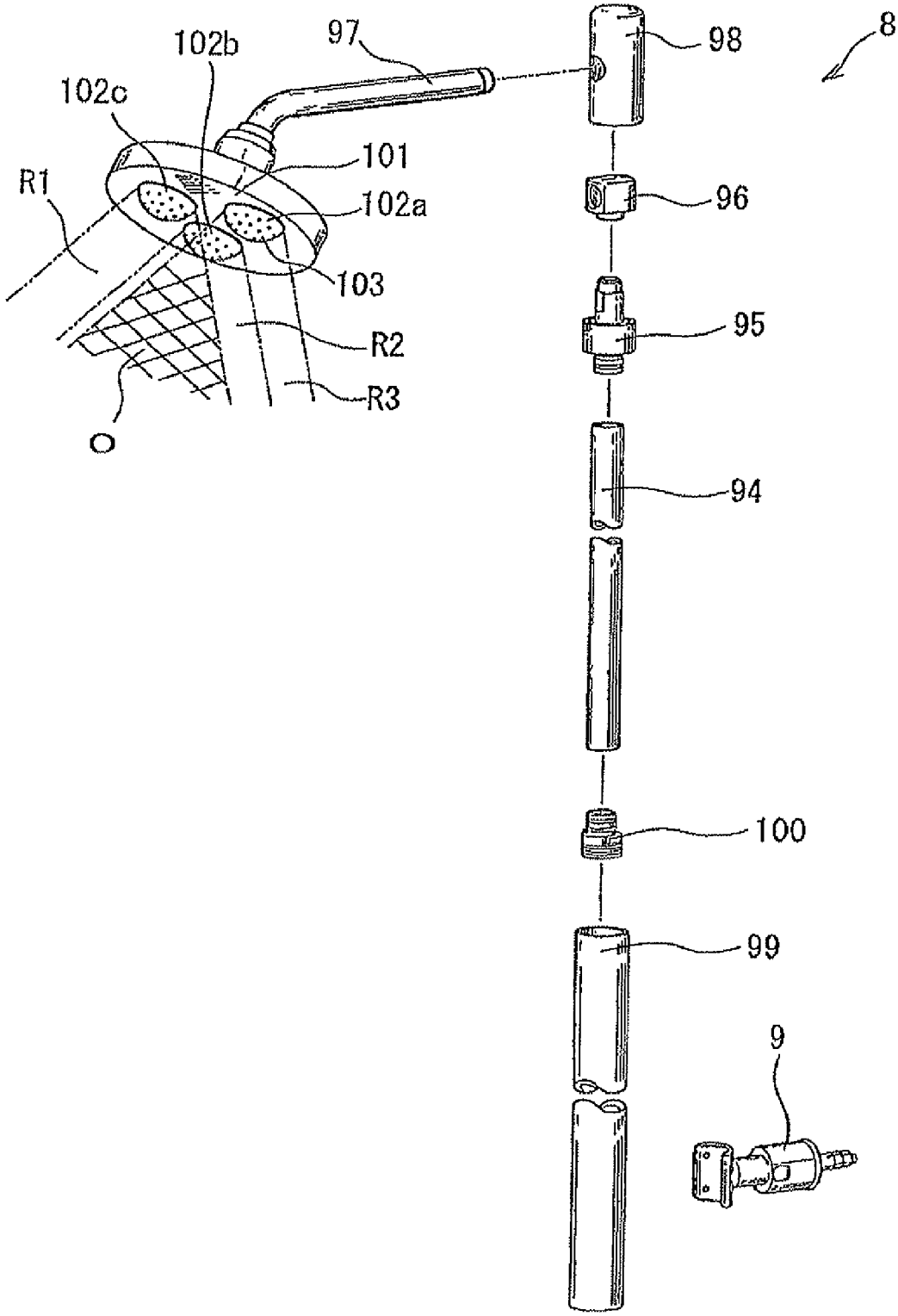
FIG. 11 is an exploded perspective view showing a head shower unit.

As shown in FIG. 11, the head shower unit 8 is constituted by a pipe-shaped coupling water passing tube 94, a head shower nozzle 97 coupled to the upper end of the water passing tube 94 through two couplings 95 and 96, a connecting portion cover member 98 for covering the outer peripheral side of the connecting portion of the two couplings 95 and 96, a water passing tube cover member 99 for covering the outer peripheral side of the coupling water passing tube 94, and a coupling 100 for connecting the lower end of the coupling water passing tube 94 to the upper end of the unit body 85 of the hand shower unit 6.

The coupling water passing tube 94 has the function of coupling the water discharge switching unit 7 (the hand shower unit 6) to the head shower unit 8, and the function of regulating the attachment position of the head shower unit 8 to have a desirable height. By preparing plural kinds of coupling water passing tubes 94 having various lengths, it is possible to easily regulate the height of the head shower unit 8 also in a construction site.

The head shower nozzle 97 includes three hemispherical water discharging portions 102(*a* to *c*) that protrude like a curve from a disk-shaped water discharging plate 101 and serves to discharge hot water from a plurality of water discharging holes 103 provided dispersedly in the vicinity of the top of the water discharging portion 102. The water discharging portion 102 can minimize the number of the water discharging holes 103 while maintaining the range of the shower water discharge within a proper range, thereby providing a feeling or sense of large amounts of water discharge. More specifically, the hot water discharged from each of the three water discharging portions 102*a* to 102*c* spreads over ranges R1 to R3 in the drawing. At this time, the water discharged from the three water discharging portions 102*a* to 102*c* overlaps with each other within a range of 0 so that a sufficient massive sense can be given to the user. Moreover, the water discharging ranges R1 and R3 from the water discharging portions 102*a* and 102*c* positioned on both ends of the water discharging plate 101 spread with difficulty because the water discharging hole 103 is dispersedly provided in the vicinity of the tops of the water discharging portions 102*a* and 102*c*. Accordingly, it is possible to intensively carry out the shower water discharge around a space in which the user is present. By the structure described above, moreover, the number of the water discharging holes 103, that is, the total opening area of the water discharging holes 103 can be minimized. Consequently, it is possible to provide a shower water discharge having a feeling or sense of large amounts of water discharge also in locations having low water pressure.

(Piping Path)

Figure 12:
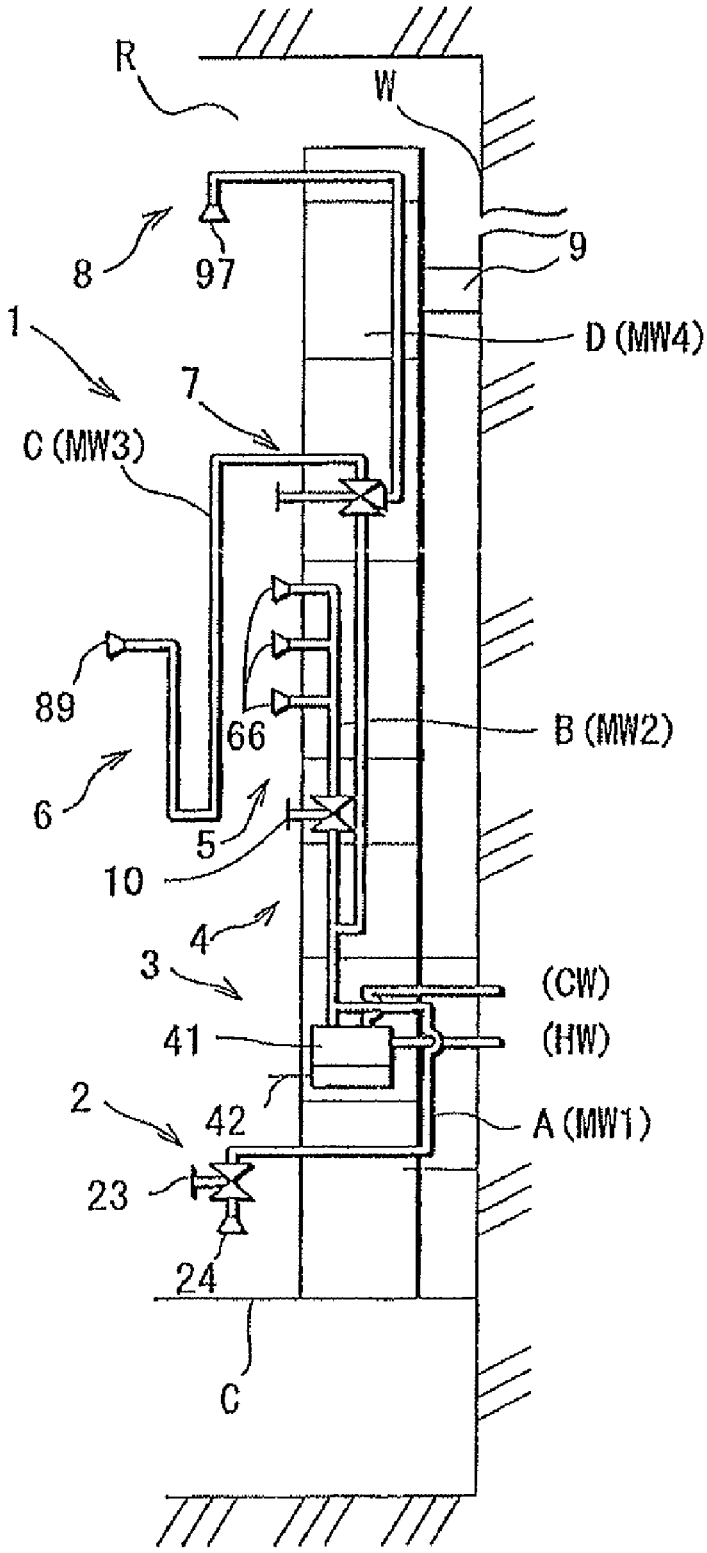
FIG. 12 is a typical view showing a piping path for the water discharging apparatus in FIG. 1.

Next, the piping path of the water discharging apparatus 1 according to the embodiment will be briefly described with reference to FIG. 12.

Hot water (HW) having a high temperature and cold water (CW) having a room temperature are supplied to the hot and cold water mixing portion 41 of the hot and cold water mixing unit 3 from a hot water supply tube and a cold water supply tube which are taken out of the wall surface W of a bathroom to an indoor side (R). Hot water MW (MW1 to 4) having a moderate temperature which is generated in the hot and cold water mixing portion 41 reaches the flow regulating valves of the water discharging units 2, 5, 6 and 8 (the water discharging handle 10, the switching handle 11 or the flow regulating handle 23) through the passages A to D. When these handles are operated to open the valve, the hot water MW1 to MW4 are discharged from the water discharging nozzles (24, 66, 89, 97) of the water discharging units.

(Variant)

The invention is not restricted to the embodiment but various changes can be made.

While the functional units are coupled to each other through the coupling in the first embodiment, for example, it is not restricted to this arrangement. It is also possible to form a coupling member integrally with the upper end and/or lower end of the unit body or the housing. The components, functions and actions of the functional units are not restricted to the example described above. A plurality of functions may be shared by one unit or one function may be divided into a plurality of units.

Figure 13:
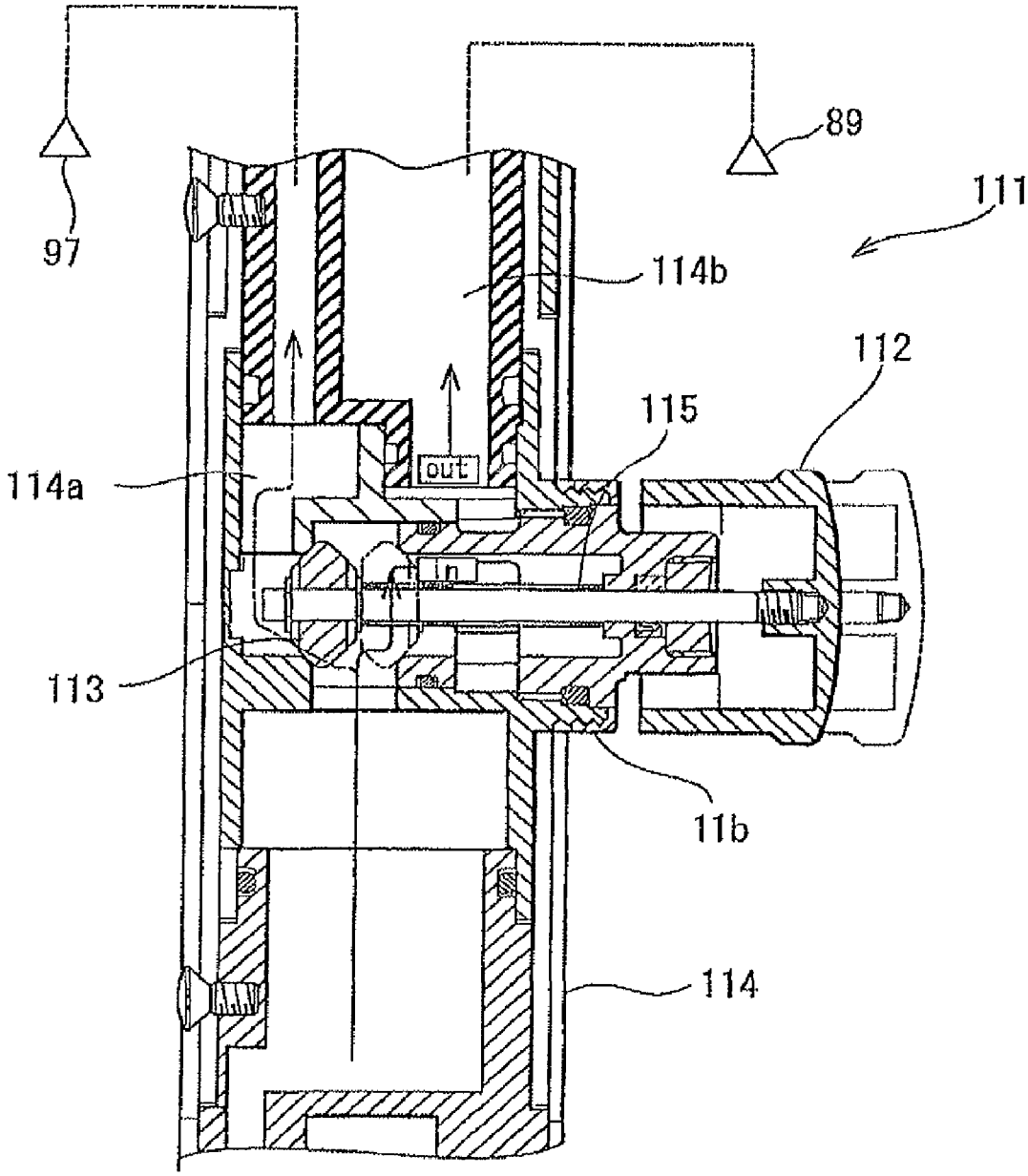
FIG. 13 is a sectional view showing the main part of a water discharge switching unit according to a variant of the invention.

For example, moreover, it is also possible to employ a structure shown in FIG. 13 for a water discharge switching unit. A water discharge switching unit 111 according to the variant features that a so-called diverter mechanism is employed as a water discharge switching mechanism in order to prevent the water from being discharged suddenly from a head shower nozzle 97 when a user operates a water discharging handle which is not shown and thus starts to discharge water. The diverter mechanism serves to automatically change over a water discharge switching handle 112 and a water discharge switching valve 113 toward a hand shower nozzle 89 side simultaneously with a water stop and to always discharge the water from the hand shower nozzle 89 when the user operates the water discharging handle to start the water discharge.

More specifically, in the water discharge switching unit 111, a water pressure in a passage 114*a* for a head shower formed in a water discharge switching unit body 114 by a partition is rapidly dropped when the user operates a water discharging handle which is not shown to stop the water discharge if the water discharge switching handle 112 is placed in a position shown in a phantom line of the drawing and the water is being discharged from the head shower nozzle 97. For this reason, the valve 113 (and the water discharge switching handle 112) is moved to a position shown in a solid line of the drawing by the energizing force of a spring 115. Consequently, the passage 114*a* for a head shower shown in a phantom line is blocked so that a passage 114*b* for a hand shower shown in a solid line communicates. When the user then operates the water discharging handle to start the water discharge, accordingly, the water is discharged from the hand shower nozzle 89. In the case in which the user wearing clothes starts to discharge the water when cleaning up a bathroom or the case in which a time passes from a last water discharge and the hot water remaining in the passage is cooled to be water having a room temperature, particularly, the diverter mechanism is effective. In the case in which the user wants to discharge the water from the head shower nozzle 97, the water discharge switching handle 112 is pulled toward a right side in the drawing against the energizing force of the spring 115 to move the valve 113 to a position shown in a phantom line of the drawing and is engaged with a discharge device which is not shown. Consequently, the passage 114*a* for a head shower communicates so that the water discharge from the head shower nozzle 97 is started.

While a thermostat mechanism is employed for the hot and cold water mixing portion in the embodiment, moreover, it is also possible to employ a conventional single lever cartridge, for example. In this case, it is preferable to connect a single lever operation handle for regulating a flow and a temperature together to the lower part of the housing of the hot and cold water mixing unit and to couple a plurality of water discharging means to the upper part of the housing.

Figure 14:
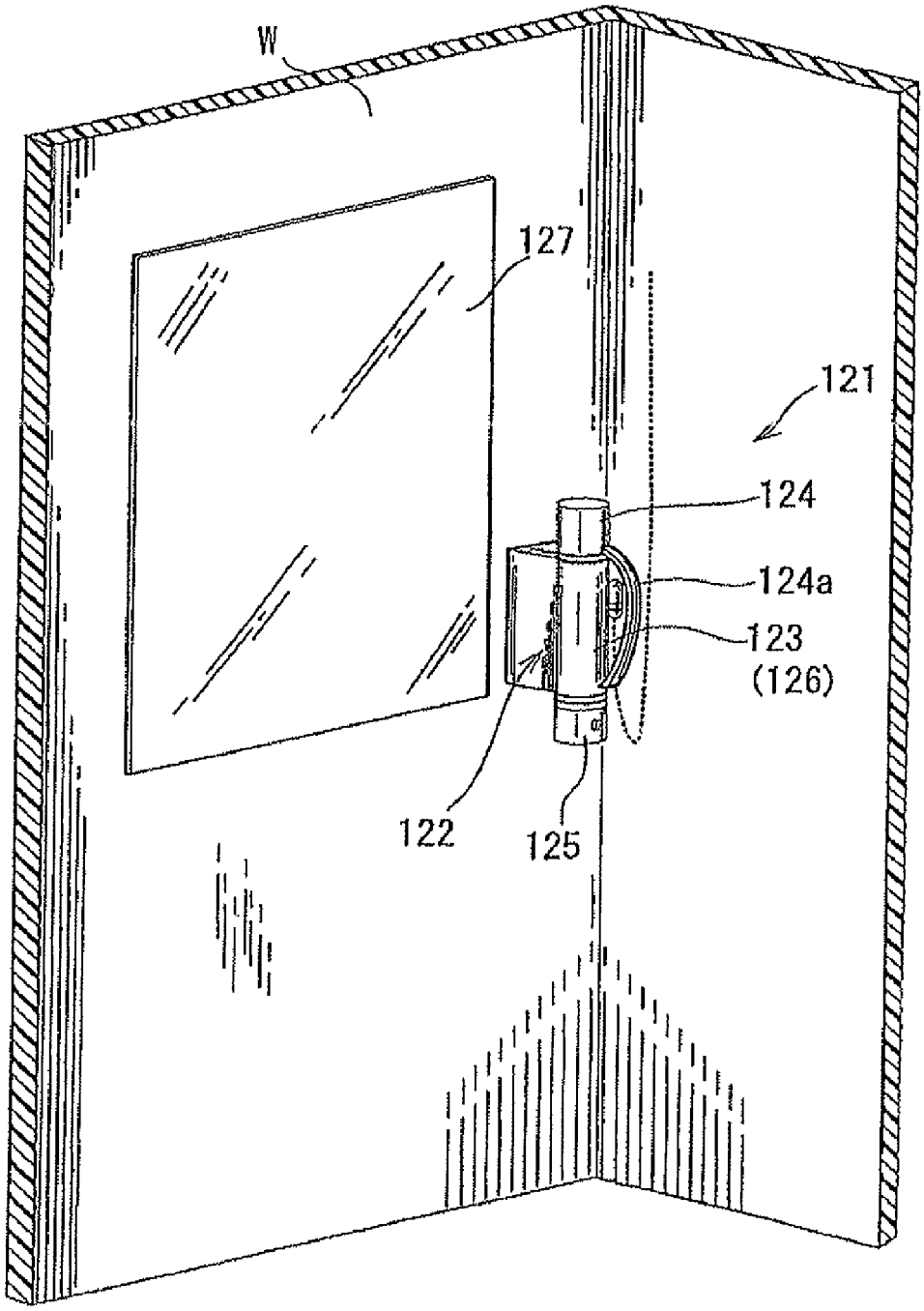
FIG. 14 is a perspective view showing a water discharging apparatus according to the variant of the invention.

The hot and cold water mixing unit can also be caused to have a structure shown in FIG. 14. A hot and cold water mixing unit 122 of a water discharging apparatus 121 according to the variant features that an arch-shaped operation assisting member 124*a* is extended integrally with a water discharging handle 124 for flow regulation. More specifically, the operation assisting member 124*a* is formed like an arch which is bulged outward from a housing 123 (a hot and cold water mixing portion 126) from a side surface on the lower end of the water discharging handle 124 connected to the upper end of the housing 123 to the vicinity of a water discharging temperature regulating handle 125 connected to the lower end of the housing 123.

Consequently, the operating force of the water discharging handle 124 can be relieved so that the aged, children and the handicapped which have smaller hands and weaker grips can also operate the water discharging handle 124 easily. In other words, it is necessary to open the water discharging valve by rotating the handle 124 against the primary pressure of a cold water supply (a hot water supply) in order to operate the water discharging handle 124. However, the aged cannot easily carry out this operation. By employing the operation assisting member 124*a* having the shape described above, therefore, it is possible to obtain the water discharging apparatus 121 which can reduce an operating force and is easy to use. In the case in which the hot and cold water mixing portion 126 is to be provided longitudinally in a vertical direction as in the invention, particularly, it is necessary to rotate the water discharging handle 124 in a circumferential direction to open the water discharging valve while supporting the weight of a user's own arm. For this reason, it is possible to obtain a particularly large advantage by employing the water discharging handle 124 having the operation assisting member 124*a*. In the case in which the water discharging handle 124 having the operation assisting member 124*a* is provided in a close position to a floor surface, furthermore, the user can also operate the water discharging handle 124 with his (her) foot.

Moreover, FIG. 14 shows an example in which the water discharging apparatus 121 is provided, for use, adjacent to a mirror 127 on a wall surface W of a shower room. As in this example, the hot and cold water mixing unit 122 is provided longitudinally in the vertical direction so that the hot and cold water mixing unit 122 can be installed just adjacent to the mirror 127 or a rack. Consequently, the user can approach the mirror 127 for the removal of makeup, for shaving or for face washing. In these actions, the hot and cold water mixing unit 122 is not an obstacle. Consequently, an ease of use can be enhanced still more. By providing such a structure, the water discharging apparatus 121 can be provided in a position in which the user can easily utilize the same device 121 in a standing state (for example, a position placed apart from approximately 1 m from a floor).

Figure 15:
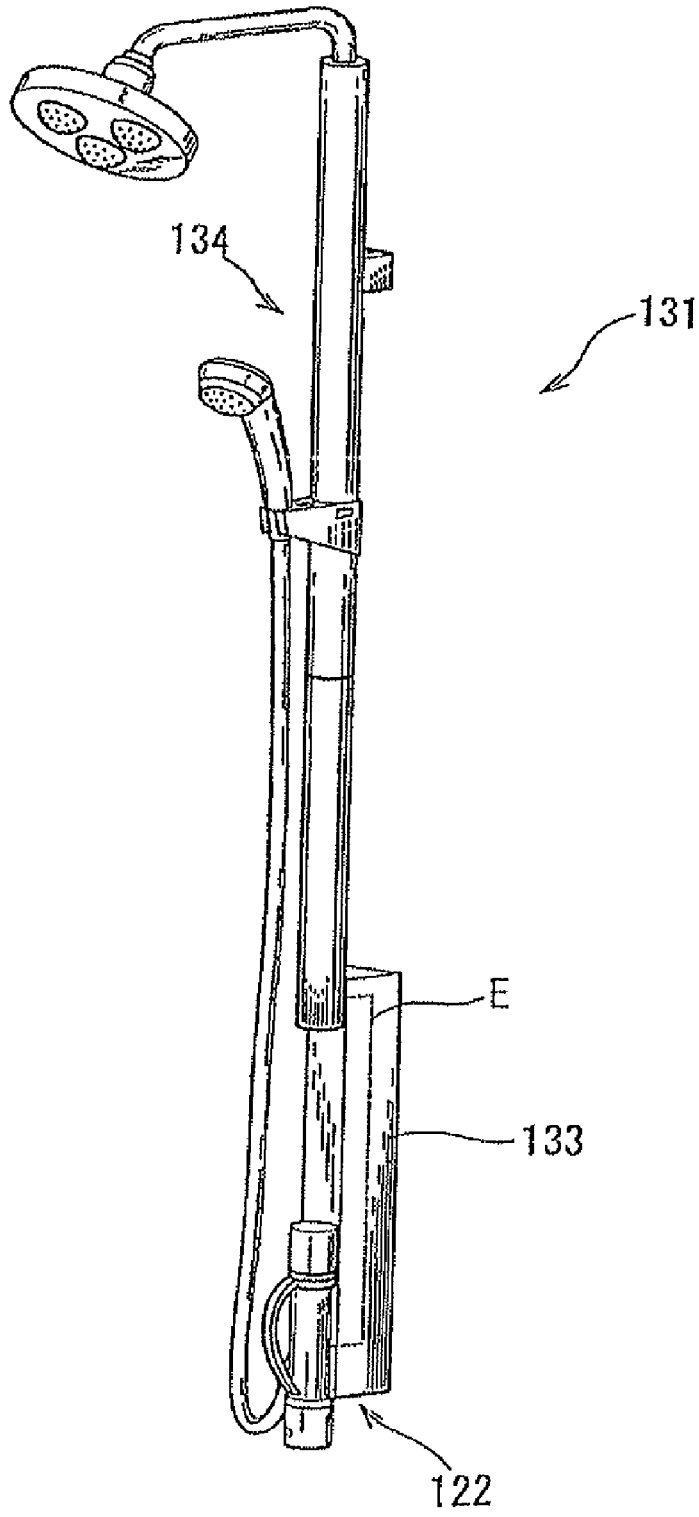
FIG. 15 is a perspective view showing a water discharging apparatus according to another variant of the invention.
Figure 16:
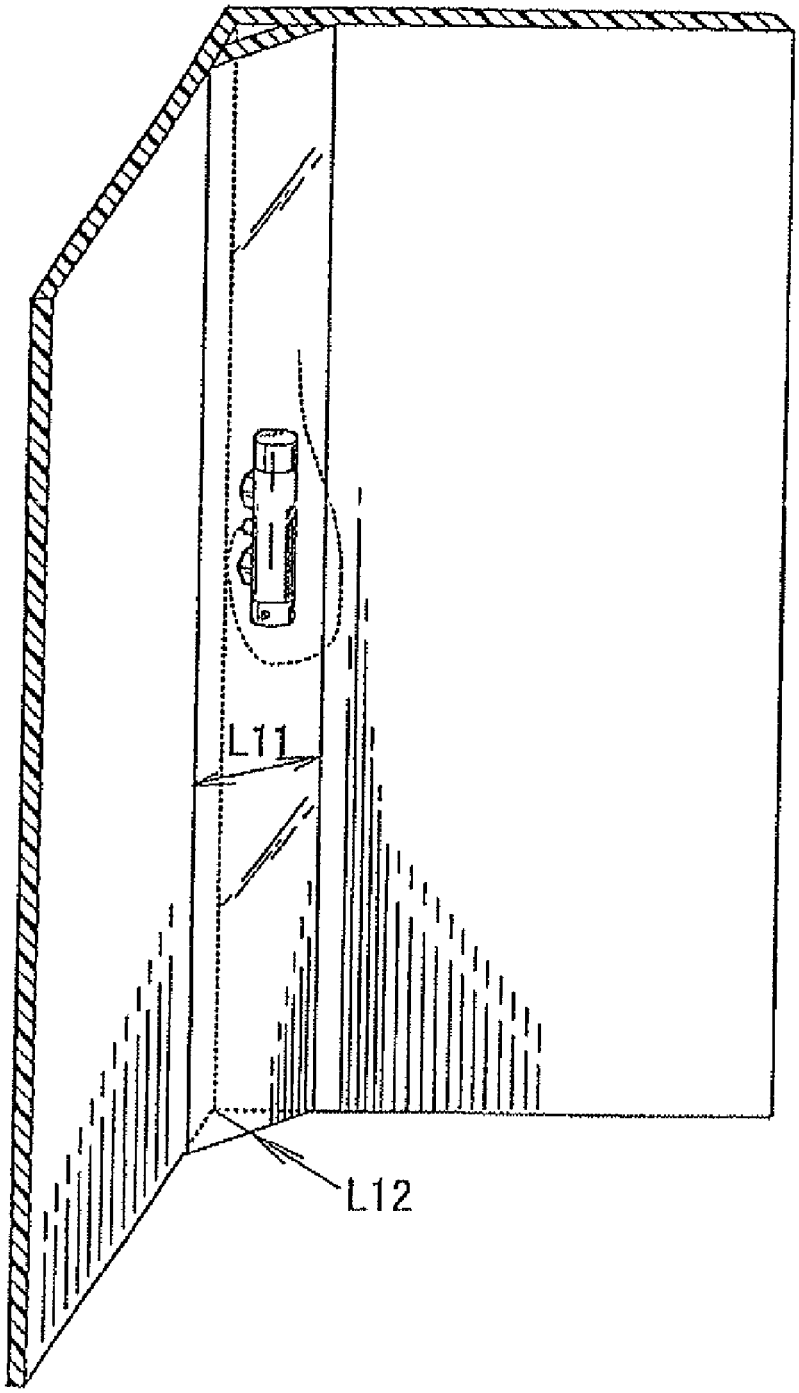
FIG. 16 is a view showing an example in which the water discharging apparatus according to the invention is installed on the corner of a bathroom.

FIG. 15 shows a water discharging apparatus 131 comprising the same hot and cold water mixing unit 122 as that in FIG. 14 according to a variant. The water discharging apparatus 131 features that a part of a passage E for supplying hot and cold water from a hot and cold water mixing unit 122 to a head shower unit 134 is provided in a leg portion cover 133 disposed behind the hot and cold water mixing unit 122. By such a structure, for example, the water discharging apparatus 131 can be provided on a counter to keep away from a rack, a mirror or a handrail. By coaxially disposing the hot and cold water mixing unit 122 and the head shower unit 134 connected to an upper part thereof, moreover, it is possible to obtain the water discharging apparatus 131 having an outer appearance with a uniformity and a novelty. A part of the passage can also pass through the back side of a wall surface or a space in the counter of a bathroom.

The invention claimed is:

1. A water discharging apparatus including a plurality of functional units coupled to each other in a vertical direction to form a pole-shaped structure, the plurality of functional units comprising:

a hot and cold water mixing portion including a housing to which a cold water supply tube and a hot water supply tube are connected respectively, a hot and cold water generating portion provided in the housing and serving to mix cold water and hot water which are supplied from the cold water supply tube and the hot water supply tube, and a hot and cold water supply passage provided in the housing and serving to supply the mixed hot and cold water for discharge from the apparatus, thereby generating hot and cold water; and a water discharging unit which comprises at least one water discharging nozzle, and a fluid passage which is integrally assembled with said at least one water discharging nozzle so as to receive the supply of the hot and cold water that is generated in the hot and cold water generating portion, wherein the water discharging unit is coupled to at least one of an upper part of the housing and a lower part of the housing, said hot and cold water supply passage provided in the housing, and said fluid passage provided with the water discharging unit are constituted to be communicated with each other, the pole-shaped structure is vertically disposed on an exposed side of a wall of a shower room such that the housing of the hot and cold water mixing portion is exposed to water discharged from said at least one water discharging nozzle; and said hot and cold water mixing portion further includes a pair of leg portions through which the cold water supply tube and the hot water supply tube, which extend from said wall, are respectively connected to the housing, and said pair of leg portions are provided on a rear part of the housing facing the wall.

2. The water discharging apparatus according to claim 1, said plurality of functional units comprising at least one additional water discharging unit, and a water discharge switching device for selectively switching the supply of mixed hot and cold water to different ones of said water discharging units, the water discharge switching device including a housing in which a plurality of passages for supplying the supply of mixed hot and cold water to the water discharging units are formed by a partition, at least one water discharging valve accommodated in the housing and serving to control a water supply/water stop of the hot and cold water to the water discharging units, and operating apparatus for operating the water discharging valve, and the water discharge switching device housing being arranged longitudinally in the vertical direction in said pole-shaped structure.

3. The water discharging apparatus according to claim 2, wherein the water discharge switching device is constituted as a water discharge switching unit having the water discharge switching device housing, the at least one water discharging valve and the operating apparatus assembled integrally.

4. The water discharging apparatus according to claim 2, wherein after the water discharging apparatus has been installed at least one of said at least one water discharging valve and the water discharging nozzle can be attached and removed via a forwardly-facing part of the water discharge switching unit housing facing away from said wall.

5. The water discharging apparatus according to claim 1, wherein said at least one water discharging nozzle is at least one selected from the group consisting of a faucet nozzle for intensively discharging the supply of mixed hot and cold water downward, a hand shower nozzle, being connected to a tip of a flexible shower hose, capable of dispersedly and intensively discharging the supply of mixed hot and cold water to a user's body, a body shower nozzle capable of dispersedly and intensively discharging the supply of mixed hot and cold water toward the user's body, and a head shower nozzle capable of dispersedly and intensively discharging the supply of mixed hot and cold water toward an upper part of the user's body.

6. The water discharging apparatus according to claim 1, said plurality of functional units comprising at least one additional water discharging unit, said water discharging units are operatively coupled together with said hot and cold water mixing portion in the vertical direction in said pole-shaped structure, the mixing portion housing is cylindrically shaped, and each of the water discharging units has an exterior cylindrically shaped body which extends longitudinally in the vertical direction and has an outermost diameter equal to an outermost diameter of the housing of the hot and cold water mixing portion such that the mixing portion housing and the cylindrically shaped bodies of the water discharging units define exterior surfaces of said pole-shaped structure which extend flush with each other.

7. The water discharging apparatus according to claim 1, wherein the water discharging unit is a head shower having a head shower nozzle, and which is capable of dispersedly and intensively discharging hot and cold water from the head shower nozzle toward an upper part of the user's body, and the head shower nozzle includes a plurality of water discharging portions which are curved and protrude from a flat water discharging plate and the hot and cold water is discharged from a plurality of water discharging holes provided dispersedly in the vicinity of tops of the water discharging portions.

8. The water discharging apparatus according to claim 1, wherein the hot and cold water mixing portion includes a temperature regulating handle for regulating a temperature of hot and cold water to be generated, and a temperature control portion for controlling the temperature of the supply of mixed hot and cold water in accordance with an operation of the temperature regulating handle, the temperature control portion has a control valve member for sliding in the hot and cold water mixing portion in the vertical direction to change a mixing ratio of cold water and hot water which is supplied from the cold water supply portion and the hot water supply portion, a temperature sensitive spring for pressing and energizing the control valve member toward one side in the vertical direction by using a shape-memory alloy, and a bias spring for pressing and energizing the control valve member toward the other side in the vertical direction, and the temperature control portion controls a position in the vertical direction of the control valve member by a balance of the two springs.

9. The water discharging apparatus according to claim 1, wherein said plurality of functional units have respective outside diameters which are equal to each other and extend substantially fully along a vertical length of the functional units, respectively, such that when said plurality of functional units are assembled end-to-end they extend flush with each other in the pole-shaped structure.

10. The water discharging apparatus according to claim 1, wherein said pair of leg portions are arranged vertically one above the other.

11. A water discharging apparatus including a plurality of functional units coupled to each other in a vertical direction to form a pole-shaped structure, the plurality of functional units comprising:

a hot and cold water mixing portion including a housing which extends longitudinally in the vertical direction and has a cold water supply tube and a hot water supply tube connected respectively thereto, a hot and cold water generating portion provided in the housing and serving to mix cold water and hot water which are supplied from the cold and hot water supply tubes for thereby generating a mixture of the hot and cold water;

a plurality of water discharging units which are coupled to more than one of upper parts and lower parts of the housing; and a water discharge switching unit which selectively switches supply of the mixture of the hot and cold water to said plurality of water discharging units, wherein each of said plurality of water discharging units comprises at least one water discharging nozzle for discharging the mixture of hot and cold water, and a water discharging unit body integrally assembled with the water discharging nozzle and having a fluid passage for supplying the mixture of hot and cold water to the water discharging nozzle, said water discharge switching unit comprises a housing which extends longitudinally in the vertical direction and having a plurality of fluid passages formed therein in a segmentation arrangement to supply the mixture of hot and cold water to said plurality of water discharging units, at least one water discharging valve which is provided in the housing so as to control supply or stoppage of the mixture of hot and cold water to said plurality of water discharging units, and operating apparatus for operating said at least one water discharging valve, said switching unit housing, said at least one water discharging valve, and said operating apparatus being integrally assembled, said water switching unit and any one of said plurality of water discharging units are coupled in the vertical direction, the pole-shaped structure is vertically disposed on an exposed side of a wall of a shower room such that the housing of the hot and cold water mixing portion is exposed to water discharged from at least one of the water discharging nozzles of the plurality of water discharging units; and said hot and cold water mixing portion further includes a pair of leg portions through which the cold water supply tube and the hot water supply tube, which extend from said wall, are respectively connected to the housing, and said pair of leg portions are provided on a rear part of the housing facing the wall.

12. The water discharging apparatus according to claim 11, wherein the hot and cold water mixing portion comprises a hot and cold water mixing unit having the mixing portion housing and the hot and cold water generating portion assembled integrally, and the water discharging units, the hot and cold water mixing unit and the water discharge switching unit are coupled in the vertical direction so as to define said pole-shaped structure.

13. The water discharging apparatus according to claim 11, wherein the mixing portion housing is cylindrically shaped, and each of the water discharging units has an exterior cylindrically shaped body which extends longitudinally in the vertical direction and has an outermost diameter equal to an outermost diameter of the housing of the hot and cold water mixing portion such that the mixing portion housing and the cylindrically shaped bodies of the water discharging units define exterior surfaces of said pole-shaped structure which extend flush with each other.

14. The water discharging apparatus according to claim 11, wherein said plurality of functional units have respective outside diameters which are equal to each other and extend substantially fully along a vertical length of the functional units, respectively, such that when said plurality of functional units are assembled end-to-end they extend flush with each other in the pole-shaped structure.

15. The water discharging apparatus according to claim 11, wherein said pair of leg portions are arranged vertically one above the other.

* * * * *